US010380827B2

(12) United States Patent
Czubak et al.

(10) Patent No.: US 10,380,827 B2
(45) Date of Patent: Aug. 13, 2019

(54) SYSTEMS AND METHODS FOR GAMING MACHINES HAVING INTERACTIVE CHAIRS

(71) Applicant: Novomatic AG, Gumpoldskirchen (AT)

(72) Inventors: Roman Czubak, Traiskircuen (AT); Christoph Bichl, Lower Austria (AT)

(73) Assignee: Novomatic AG, Gumpoldskirchen (AT)

( * ) Notice: Subject to any disclaimer, the term of this patent is extended or adjusted under 35 U.S.C. 154(b) by 10 days.

(21) Appl. No.: 15/440,710

(22) Filed: Feb. 23, 2017

(65) Prior Publication Data

US 2018/0240297 A1 Aug. 23, 2018

(51) Int. Cl.
*G07F 17/32* (2006.01)

(52) U.S. Cl.
CPC ..... *G07F 17/3209* (2013.01); *G07F 17/3216* (2013.01); *G07F 17/3227* (2013.01); *G07F 17/3244* (2013.01)

(58) Field of Classification Search
CPC ... G07F 17/3211; G07F 17/3223; A63F 13/08
See application file for complete search history.

(56) References Cited

U.S. PATENT DOCUMENTS

| | | | |
|---|---|---|---|
| 5,680,133 | A | 10/1997 | Komatsu |
| 7,625,288 | B1 | 12/2009 | Steelman |
| 9,336,646 | B2 | 5/2016 | Pirvu |
| 9,779,584 | B1 | 10/2017 | Czubak |
| 2006/0014586 | A1 | 1/2006 | Gatto et al. |
| 2006/0025210 | A1 | 2/2006 | Johnson |
| 2007/0268266 | A1* | 11/2007 | XiaoPing ..... G06F 3/044 345/173 |
| 2008/0108423 | A1 | 5/2008 | Benbrahim |
| 2009/0062004 | A1 | 3/2009 | Vedurmudi |
| 2009/0275399 | A1 | 11/2009 | Kelly et al. |
| 2009/0284401 | A1 | 11/2009 | Nanevicz |
| 2009/0305776 | A1 | 12/2009 | Englman et al. |

(Continued)

FOREIGN PATENT DOCUMENTS

| | | |
|---|---|---|
| WO | 2006015335 | 2/2006 |

OTHER PUBLICATIONS

"Controlling the GPIO on a Raspberry Pi with a Touchscreen," Ozzmaker (Sep. 10, 2013), http://ozzmaker.com/controlling-the-gpio-on-a-raspberry-pi-with-a-touchscreen/.

(Continued)

*Primary Examiner* — David L Lewis
*Assistant Examiner* — Robert E Mosser
(74) *Attorney, Agent, or Firm* — Snell & Wilmer L.L.P.

(57) ABSTRACT

A gaming system may include a gaming machine, a touchscreen device in electronic communication with the gaming machine, and a gaming chair mechanically coupled to the touchscreen device. The position of the touchscreen device may be adjustable relative to the gaming chair. The gaming machine may perform an action in response to a signal from the touchscreen device. The touchscreen device may communicate with the gaming machine via a conduit plugged into a hardware port of the gaming machine, for example. The action performed by the gaming machine in response to the signal may include, for example, starting a game, cashing out, retrieving information, selecting pay lines, adjusting a bet, or requesting an attendant.

17 Claims, 8 Drawing Sheets

(56) References Cited

U.S. PATENT DOCUMENTS

| | | | | |
|---|---|---|---|---|
| 2010/0048293 | A1 | 2/2010 | Hornik | |
| 2010/0304832 | A1 | 12/2010 | Kup-Ferroth | |
| 2011/0021268 | A1 | 1/2011 | Bramble | |
| 2011/0261273 | A1* | 10/2011 | Weaver | B60R 11/0235 348/837 |
| 2013/0137524 | A1 | 5/2013 | Scott | |
| 2013/0225277 | A1 | 8/2013 | Hughes | |
| 2014/0162762 | A1 | 6/2014 | Aoki et al. | |
| 2015/0277755 | A1* | 10/2015 | Hoffman | G06F 3/04886 705/12 |
| 2016/0027257 | A1 | 1/2016 | Yoseloff et al. | |
| 2016/0042609 | A1 | 2/2016 | Kitamura | |
| 2017/0053486 | A1 | 2/2017 | Talkeda | |
| 2017/0169657 | A1 | 6/2017 | Keilwert | |
| 2017/0301185 | A1 | 10/2017 | Bryant et al. | |

OTHER PUBLICATIONS

USPTO; Office Action dated Feb. 21, 2017 in U.S. Appl. No. 15/362,469.
USPTO; Final Office Action dated Jun. 26, 2017 in U.S. Appl. No. 15/362,469.
USPTO; Notice of Allowance dated Aug. 14, 2017 in U.S. Appl. No. 15/362,469.
EPO; European Search Report dated Dec. 12, 2017 in Application No. 17198384.4.
Non-Final Office Action dated Apr. 20, 2018 in U.S. Appl. No. 15/783,602.
International Search Report and Written Opinion dated May 9, 2018 in Application No. PCT/IB2018/051154.
Codding et al., "Addressing, Accessing and Interfacing Peripheral Devices to Microprocessors," Department of Chemistry, University of Calgary, Talanta, vol. 28, 503-518 (1981).

* cited by examiner

SYSTEMS AND METHODS FOR GAMING MACHINES HAVING INTERACTIVE CHAIRS

FIELD

The present disclosure relates generally to gaming machines and, more particularly, to gaming machines found in casinos or betting environments.

BACKGROUND

Gaming machines, otherwise known as slot machines, poker machines, video lottery terminals, or gaming consoles, have proven very popular within the gaming environment to become one of the base elements of the gaming industry. Players, however, quickly become tired of various adaptations of gaming machines, demanding new and inventive ways to represent or play games on such gaming machines. For this reason, game creators must continually invent new and innovative ways to represent games, game play, and award types to stimulate players to encourage further interest.

Players may also experience fatigue when playing casino games. Fatigue can result from the spatial relationship between the gaming chair and the controls on the gaming machine. Players may have to lean forward or sit in the chair in an unnatural position to engage the controls. Game creators may thus take into consideration player comfort in designing interfaces to extend player interest.

SUMMARY

Systems and methods for controlling a gaming machine may enable control by a separate touchscreen device according to various embodiments. The touchscreen device may be integrated into a gaming chair or otherwise be remote from the gaming machine. The touchscreen device may allow for comfortable interaction with a gaming machine while sitting in the gaming chair.

In various embodiments, a gaming system may include a gaming machine, a touchscreen device in electronic communication with the gaming machine, and a gaming chair mechanically coupled to the touchscreen device. The position of the touchscreen device may be adjustable relative to the gaming chair. The gaming machine may perform an action in response to a signal from the touchscreen device. The touchscreen device may communicate with the gaming machine via a conduit plugged into a hardware port of the gaming machine, for example. The action performed by the gaming machine in response to the signal may include, for example, starting a game, cashing out, retrieving information, selecting pay lines, adjusting a bet, or requesting an attendant.

In various embodiments, an interactive interface may be displayed on the touchscreen device. The interface may comprise selection frame fixed relative to a boundary of the interactive interface. A selection bar may have a plurality of buttons rendered behind the selection frame. A button from the plurality of buttons is positioned within the selection frame in response to a swipe gesture. A selectable button associated with the action may be rendered in response to the button being positioned within the selection frame.

BRIEF DESCRIPTION OF THE DRAWINGS

Non-limiting and non-exhaustive embodiments of the present disclosure are described with reference to the following figures, wherein like reference numerals refer to like parts throughout the various views unless otherwise specified.

DETAILED DESCRIPTION

Figure 1A:
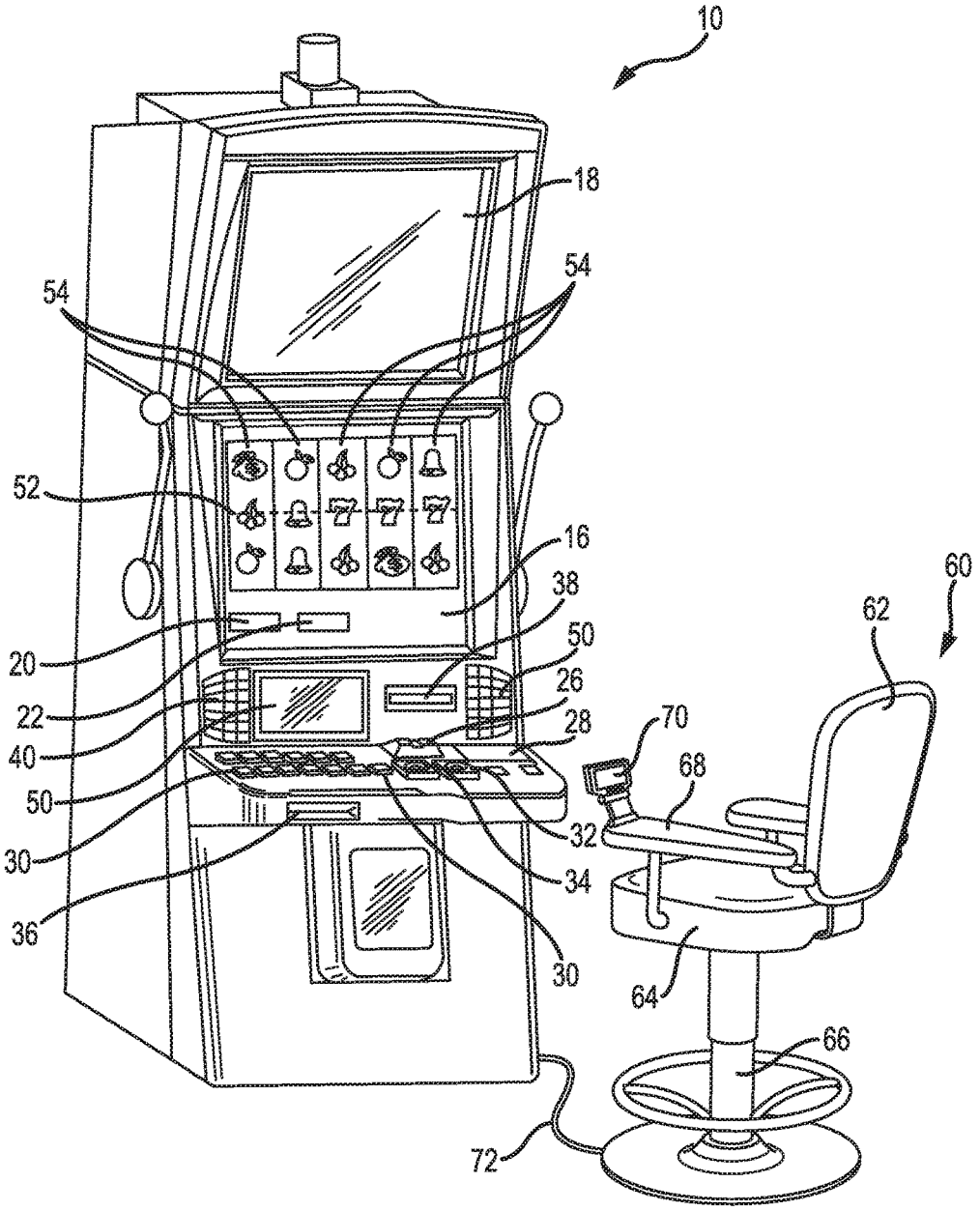
FIG. 1A illustrates a perspective view of a gaming machine having an interactive gaming interface integrated into the chair, according to various embodiments.

Reference throughout this specification to "one embodiment", "an embodiment", "one example" or "an example" means that a particular feature, structure or characteristic described in connection with the embodiment or example is included in at least one embodiment of the present disclosure and may be variously included on many embodiments. Thus, appearances of the phrases "in one embodiment", "in an embodiment," "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

Several (or different) elements discussed below, and/or claimed, are described as being "coupled," "in communication with," or "configured to be in communication with." This terminology is intended to be non-limiting, and where appropriate, be interpreted to include without limitation, wired and wireless communication using any one or a plurality of a suitable protocols, as well as communication methods that are constantly maintained, are made on a periodic basis, and/or made or initiated on an as needed basis.

The methodologies described herein may be implemented by various means depending upon applications according to particular examples. For example, such methodologies may be implemented in hardware, firmware, software, or combinations thereof. In a hardware implementation, for example, the controller or processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, and other device designed to perform the functions described herein, or combinations thereof.

Some portions of the description included herein are presented in terms of algorithms or symbolic representations of operations on binary digital signals stored within a memory of a specific apparatus or special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the signal processing or related arts to convey the substance of their work to others skilled in the art. An algorithm as described here is generally considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be appreciated, however, that all of these or similar terms are to be associated with appropriate physical quantities and are merely convenient labels.

Unless specifically stated otherwise, as apparent from the discussion herein, it is appreciated that throughout this specification discussions utilizing terms such as "processing," "computing," "calculating," "determining" or the like, refer to actions or processes of a specific apparatus, such as a special purpose computer or a similar special purpose electronic computing device. In the context of this description, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

For clarity in discussing the various functions of the system, multiple computers and/or servers are discussed as performing different functions. These different computers (or servers) may, however, be implemented in multiple different ways such as modules within a single computer, or as nodes of a computer system, etc. The functions performed by the system (or nodes or modules) may be centralized or distributed in any suitable manner across the system and its components, regardless of the location of specific hardware. Furthermore, specific components of the system may be referenced using functional terminology in their names. The function terminology is used solely for purposes of naming convention and to distinguish one element from another in the following discussion. Unless otherwise specified, the name of an element conveys no specific functionality to the element or component. It should be appreciated that, in select embodiments, the software, hardware, and associated components of the system may be programmed and configured to implement one or more embodiments described herein. It should also be appreciated that the various aspects of the system may be exemplified as software, modules, nodes, etc., of a computer or server.

Embodiments of the present invention may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and/or memory devices. In such a "thick client" embodiment, the gaming device local processor executes the communicated computerized instructions to control any games (or other suitable interfaces) provided to a player.

Figure 1B:
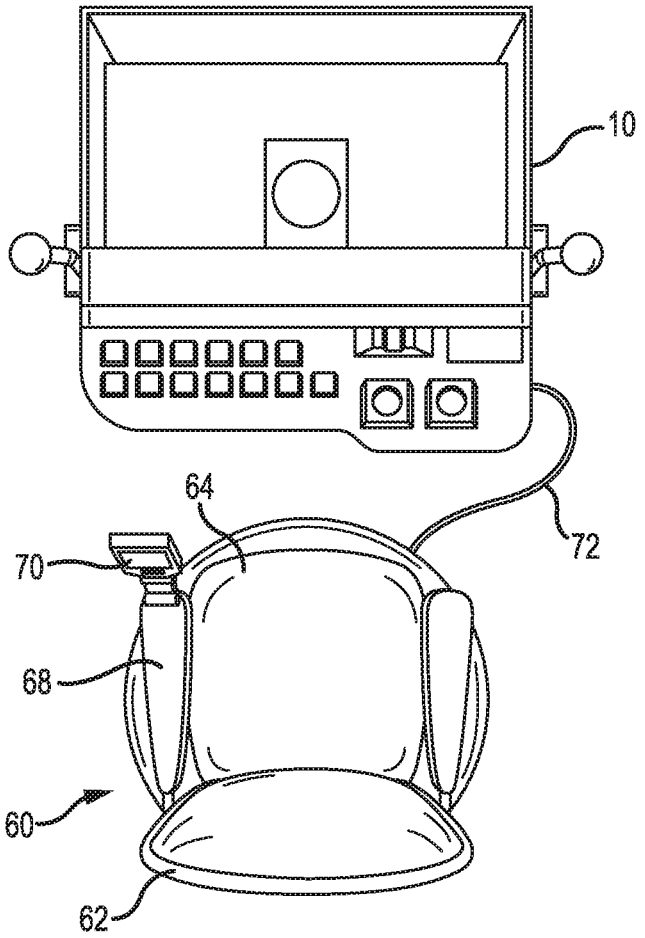
FIG. 1B illustrates a top view of a gaming machine having an interactive gaming interface integrated into the chair, according to various embodiments.

Referring to FIGS. 1A and 1B, one embodiment of a gaming machine or device 10, according to the present disclosure, has a support structure, housing, or cabinet which provides support for a plurality of displays, inputs, controls, and other features of a conventional gaming machine. The gaming machine 10 can be positioned on a base or stand or can be configured as a pub-style table-top game (not shown) which a player can operate preferably while sitting. It should be appreciated that the gaming machine 10 may have varying cabinet and display configurations.

Figure 2:
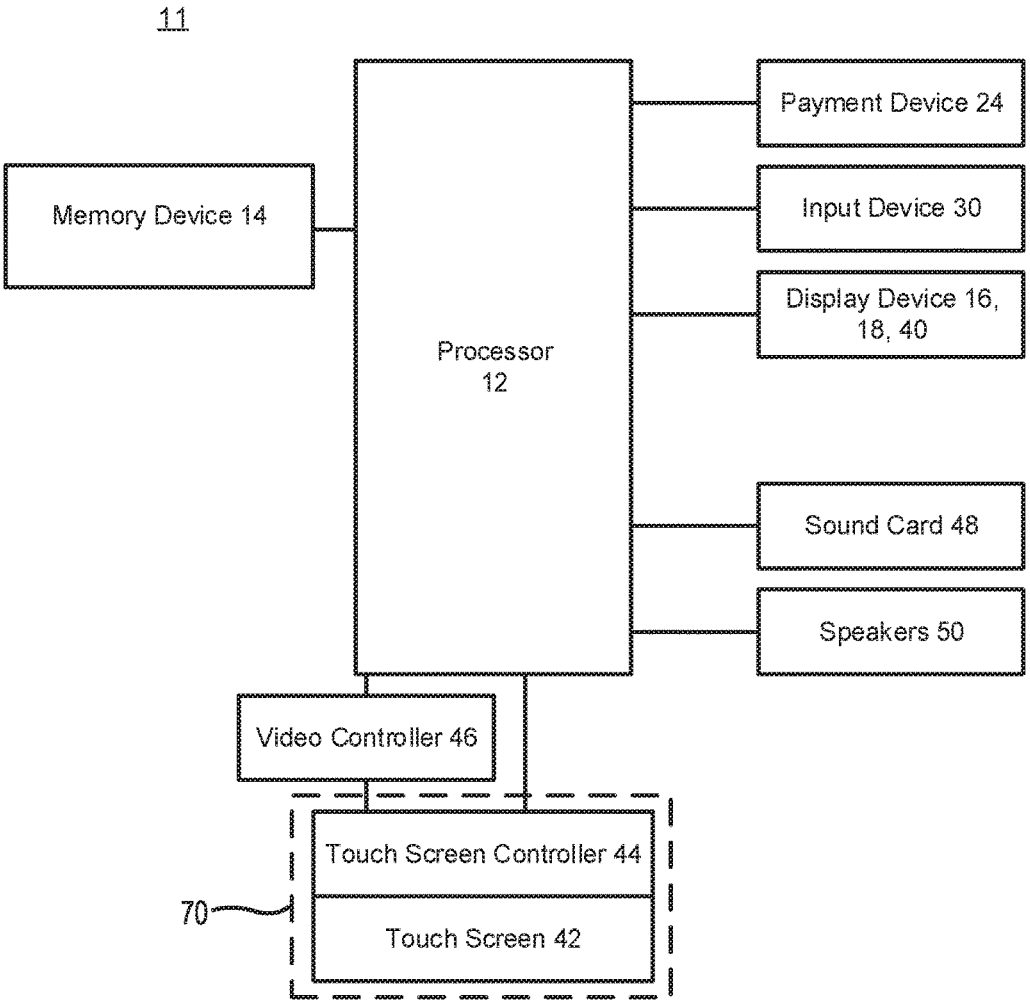
FIG. 2 illustrates a block diagram of an electronic gaming system, in accordance with various embodiments.

In various embodiments, as illustrated in FIG. 2, an electronic system 11 for playing the casino game is shown, according to the present disclosure. The electronic system 11 may be a separate gaming system or may be part of the gaming machine 10 of FIGS. 1A and 1B. The electronic system 11 includes at least one processor 12, such as a microprocessor, a microcontroller-based platform, a suitable integrated circuit or one or more application-specific integrated circuits (ASIC's). The processor 12 is in communication with or operable to access or to exchange signals with at least one data storage or memory device 14. In one embodiment, the processor 12 and the memory device 14 reside within the cabinet of the gaming machine 10. The memory device 14 stores program code and instructions, executable by the processor 12, to control the gaming machine 10. The memory device 14 also stores other data such as image data, event data, player input data, random or pseudo-random number generators, pay-table data or information, and applicable game rules that relate to the play of the casino game. In one embodiment, the memory device 14 includes random access memory (RAM), which can include non-volatile RAM (NVRAM), magnetic RAM (MRAM), ferroelectric RAM (FeRAM), and other forms as commonly understood in the gaming industry. In one embodiment, the memory device 14 includes read only memory (ROM). In one embodiment, the memory device 14 includes flash memory and/or electrically erasable programmable read only memory (EEPROM). It should be appreciated that, any other suitable magnetic, optical, and/or semiconductor memory may operate in conjunction with the electronic system 11.

In one embodiment, part or all of the program code and/or operating data described above can be stored in a detachable or removable memory device 14, including, but not limited to, a suitable cartridge, disk, CD ROM, DVD, or USB memory device. In other embodiments, part or all of the program code and/or operating data described above can be downloaded to the memory device 14 through a suitable network.

In various embodiments, an operator or a player can use a removable memory device in a desktop computer, a laptop computer, a hand-held device, such as a personal digital assistant (PDA), a portable computing or mobile device, or another computerized platform to implement present disclosure. In various embodiments, the electronic system 11 is operable over a wireless network, for example as part of a wireless gaming system. In such embodiments, the electronic system 11 may be a hand-held device, a mobile device, or any other suitable wireless device that enables a player to play any suitable game at a variety of different locations. Gaming machine 10 may thus include integrated wireless chips and/or add-on wireless chips integrating into gaming machine 10 via a plug-in interface. In various embodiments in which the electronic system 11 is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor 12 and memory device 14 may be collectively referred to herein as a "computer" or "controller."

In one embodiment, the gaming machine 10 randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, as illustrated in FIG. 2, the electronic system 11 includes one or more display devices 16, 18, 40 controlled by the processor 12. Display devices 16, 18, 40 are preferably connected to or mounted on the cabinet of the gaming machine 10. The embodiment shown in FIG. 1A includes a central display device 16 which displays a primary or base game and an upper display device 18. This display device 16 may also display any suitable secondary game associated with the primary or base game as well as information relating to the primary or secondary game. The upper display device 18 may display the primary game, any suitable secondary game associated or not associated with the primary game and/or information relating to the primary or secondary game. These display devices may also serve as digital glass operable to advertise games or other aspects of the gaming establishment. As seen in FIG. 1A, in one embodiment, the gaming machine 10 includes a credit display 20 which displays a player's current number of credits, cash, account balance, or the equivalent. In one embodiment, the gaming machine 10 includes a bet display 22 which displays a player's amount wagered. In one embodiment, the gaming machine 10 includes a player tracking display 40 which displays information regarding a player's play tracking status. It should be appreciated that these devices are in communication with the processor 12.

In another embodiment, at least one display device may be a mobile display device, such as a PDA or tablet PC that enables play of at least a portion of the primary or secondary game at a location remote from the gaming machine 10 or electronic system 11.

Display devices 16, 18, 40 may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a virtual reality headset, a display including a projected and/or reflected image, or any other suitable electronic device or display mechanism. In one embodiment, as described in more detail below, the display devices include a touchscreen with an associated touchscreen controller. The display devices may be of any suitable size and configuration, such as a square, a rectangle or an elongated rectangle.

Display devices 16, 18, 40 of the gaming machine 10 are configured to display at least one and preferably a plurality of games or other suitable images, symbols and indicia such as any visual representation or exhibition of the movement of objects such as mechanical, virtual, or video reels and wheels, etc., and the like.

In one embodiment, the symbols, images and indicia displayed on or of the display device may be in mechanical form. That is, the display device may include any electro-mechanical device, such as one or more mechanical objects, such as one or more rotatable wheels or reels configured to display at least one or a plurality of games or other suitable images, symbols or indicia.

Gaming device 10 may also include a touchscreen device 70. Touchscreen device 70 comprises a display similar to display devices 16, 18, and 40. Touchscreen device 70 is also capable of detecting touches at various locations on the screen and performing an action in response to the touch. Touchscreen device 70 may thus be a resistive touchscreen, a capacitive touchscreen, a projected capacitive touchscreen, a surface acoustic wave (SAW) touchscreen, or an infrared touchscreen, for example.

In various embodiments, touchscreen device 70 may be integrated into a gaming chair 60. Gaming chair 60 may include a back 62 coupled to a seat 64. The incline of back 62 may be adjustable relative to seat 64. In that regard, gaming chair 60 may recline into a substantially flat or laying position or inclined into an upright seating position, or any position in between. Gaming chair may also be configured as a different type of seating apparatus such as a massage table or bed with touchscreen device 70 selectively positioned within reach and field of view of an occupant.

Arms 68 may be coupled to back 62 and/or seat 64. Arms 68 may be adjustable in height relative to seat 64 and/or back 62. Touchscreen device 70 may also be adjustable relative to arms 68, seat 64, and/or back 62. Gaming chair 60 may be supported by a base 66, which may also be height adjustable. Gaming chair 60 and touchscreen device 70 may also be configured to provide haptic feedback in response to user selections.

Gaming chair 60 is in electronic communication with gaming machine 10 via electrical conduit 72. Although an electrical conduit 72 is illustrated, gaming chair 60 and/or touchscreen device 70 may be in communication with gaming device 10 via a wireless communication channel. For example, a touchscreen device 70 may connect to gaming machine 10 via a Bluetooth® signal, 802.11 wireless protocols, near field communication, and/or via other suitable wireless communication standards.

The various components of electronic system 11 may integrate with processor 12 using a controller board. The controller board may be a circuit board or semiconductor device that accepts inputs from and provides outputs to the various hardware components of electronic system 11 described herein. The control board may have interface ports that connect to input device 30, display devices 16, 18, and 40, sound card 48, speakers 50, touchscreen device 70, and/or any other component that supports electronic communication with gaming machine 10. In that regard, touchscreen device 70 may be configured to connect with a pre-existing gaming device in a plug-and-play manner. Stated another way, touchscreen device 70 may integrate into existing gaming machines 10 by altering the controller and/or controller software of the gaming machine 10 without altering the underlying game software. Gaming chair 60 may thus be retrofitted into machines originally manufactured without a gaming chair 60 having a touchscreen device 70 in mind.

Gaming chair 60 and touchscreen device 70 provide an augmented gaming experience. Users can sit in gaming chair 60 and control gaming machine 10 from comfortable positions without leaning forward excessively to engage gaming machine 10 directly. Similarly, gamine chair 60 may be reclined relative to a gaming machine with touchscreen device 70 positioned within reach and field of sight for a user to control gaming machine 10 from a playing position, nearby or otherwise distant from gaming machine 10. Touchscreen device 70 provides a full set of controls or a subset of controls available for gaming machine 10. Controls may be selectable to request a state change in gaming machine 10. For example, touchscreen device 10 may include controls to start a game, cash out, retrieve information, select pay lines, play max bet, increase bet, decrease bet, select a game type, stop a game, request an attendant or otherwise interact with gaming machine 10.

Figure 1C:
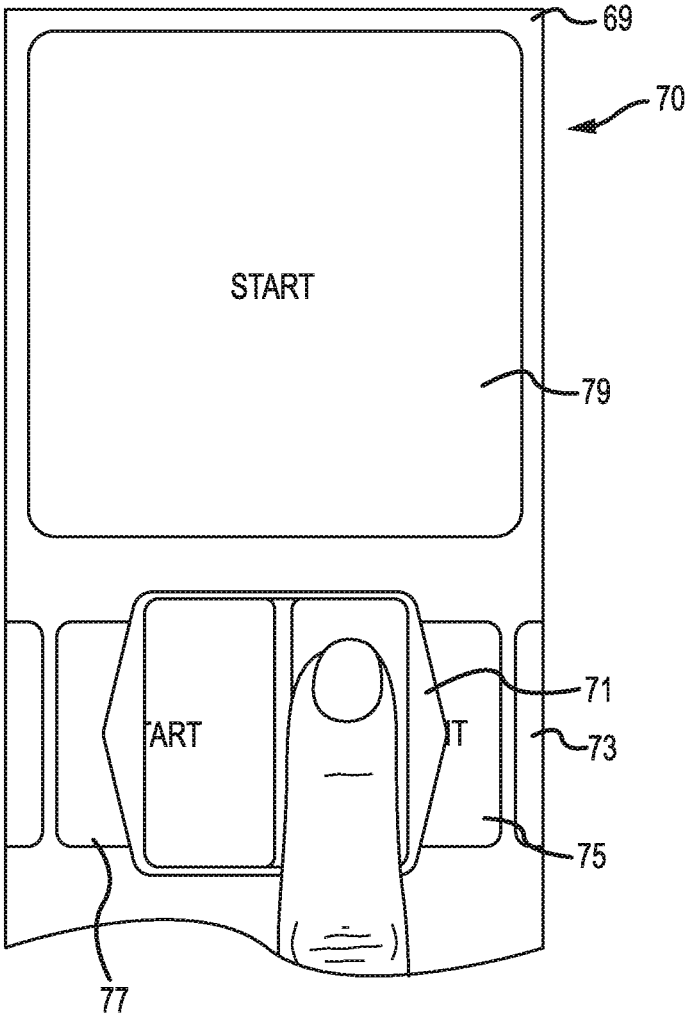
FIG. 1C illustrates an exemplary interactive interface for a touchscreen device, according to various embodiments.

Referring to FIG. 1C, an exemplary interface 69 for touchscreen device 70 is shown according to various embodiments. Interface 69 may include a selection frame 71 fixed in position relative to one or more boundaries of the screen. Selection bar 73 may be swiped to the left or right in interface 69 to move buttons relative to selection frame 71. As depicted, a user is swiping from selection bar 73 to the left to move a button 77 out of selection frame 71, and to move a button 75 into selection frame 71. Button 77 last present in selection frame 71 may be displayed as selectable button 79. A player may thus identify a desired action by positioning the corresponding button in selection frame 71. The player may then request execution of the desired action by pressing selectable button 79 when the button corresponding to the desired action is displayed as selectable button 79. Interface 69 may thus trigger an action in gaming machine 10 (shown in FIG. 1A) in response to touchscreen device 70 detecting a player pressing a selectable button 79.

As illustrated in FIG. 2, in one embodiment, the electronic system 11 includes at least one payment device 24 in communication with the processor 12. The payment device 24 may accept a physical item associated with a monetary value and may establish or increase a credit balance for the player based on the monetary value. The payment device 24 may be a payment acceptor including a note, ticket or bill acceptor 28 (shown in FIG. 1A) wherein the player inserts paper money, a ticket, or voucher in a coin slot 26 (shown in FIG. 1A) where the player inserts money, coins, or tokens. In other embodiments, payment device 24 such as readers or validators for credit cards, debit cards or credit slips may accept payment.

In one embodiment, a player may insert an identification card into a card reader of the gaming machine 10. In one embodiment, the identification card is a smart card having a programmed microchip, a coded magnetic strip or coded rewritable magnetic strip, and the programmed microchip or magnetic strips are coded with a player's identification, credit totals (or related data), and/or other relevant information. In another embodiment, a player may log into a touchscreen device 70 integrated into gaming chair 60 or separate touchscreen device 70 such a smart phone, a tablet, for example, which communicates a player's identification, credit totals (or related data), and other relevant information to the gaming machine 10. In one embodiment, money may be transferred to a gaming machine 10 through electronic funds transfer. It should be appreciated that, when a player funds the gaming machine 10, the processor 12 determines the amount of funds entered and displays the corresponding amount as a credit or other suitable display as described previously.

As seen in FIGS. 1A and 2, in one embodiment, the gaming machine 10 and electronic system 11 include at least one and preferably a plurality of input devices 30 in communication with the processor 12. The input devices can include any suitable device which enables the player to produce an input signal which is received by the processor 12. In one embodiment, after appropriate funding of the gaming machine 10, the input device is a game activation device, such as a play button 32 or a pull arm (not shown) which is used by the player to start any primary or base game or sequence of events in the gaming machine 10. The play button can be any suitable play activator such as a bet one button, a max bet button, or a repeat the bet button. In one embodiment, upon appropriate funding, the gaming machine 10 begins the game play automatically. In another embodiment, upon the player engaging one of the play buttons, the gaming machine 10 automatically activates game play. Touchscreen device 70 is thus an additional input device suitable for triggering actions by gaming machine 10. Touchscreen device 70 may trigger any of the actions described herein in addition to other suitable actions gaming machine 10 may be configured to execute. In that regard, digital buttons may be displayed on touchscreen device 70 to trigger various responses in gaming machine 10.

In one embodiment, one input device is a wager input device, such as a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button or one or more intermediate bet buttons (not shown) which enable the player to bet the maximum wager or one or more intermediate wagers, respectively, that are permitted or accepted for a game of the gaming machine 10.

In one embodiment, one input device is a cash out button 34. The player may push the cash out button and initiate a "cash out" operation to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. In one embodiment, the gaming machine 10 includes at least one card reader 38 in communication with the processor 12. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. It should be appreciated that any suitable payout mechanism, such as funding to the player's electronically recordable identification card or smart card, may be implemented in accordance with the gaming machine 10.

In one embodiment, as mentioned above and as seen in FIG. 2, one input device is a touchscreen 42 coupled with a touchscreen controller 44 or some other touch-sensitive display overlay to allow for player interaction with the images on the display. The touchscreen and the touchscreen controller are connected to a video controller 46. A player can make decisions and input signals into the gaming machine 10 or the electronic system 11 by touching the touchscreen at the appropriate locations. One such input device is a conventional touchscreen button panel. Touchscreen 42 may be integrated into touchscreen device 70, or may be a separate touchscreen device integrated directly into gaming machine 10.

The electronic system 11 may further include a plurality of communication ports for enabling communication of the processor with external peripherals, such as external video sources, expansion buses, game or other displays, a SCSI port, or a keypad.

In one embodiment, as seen in FIG. 2, the electronic system 11 includes a sound generating device controlled by one or more sound cards 48 which function in conjunction with the processor 12. In one embodiment, the sound generating device includes at least one and preferably a plurality of speakers 50 or other sound generating hardware and/or software for generating sounds, such as by playing music for the primary and/or secondary game or by playing music for other modes of the gaming machine 10, such as an attract mode. In one embodiment, the gaming machine 10 provides dynamic sounds coupled with attractive multimedia images displayed on one or more of the display devices to provide an audio-visual representation or to otherwise display full-motion video with sound to attract players to the gaming machine 10. During idle periods, the gaming machine 10 may display a sequence of audio and/or visual attraction messages to attract potential players to the gaming device. The videos may also be customized to provide any appropriate information.

The gaming machine 10 can incorporate any suitable wagering game as the primary or base game. The gaming machine 10 may include some or all of the features of conventional gaming machines or devices. In one embodiment, the primary or base game may be any suitable reel-type game susceptible to representation in an electronic or electromechanical form, which in one embodiment produces a random outcome based on probability data at the time of or after placement of a wager. Alternatively, the primary or base game may be a video poker game, a video bingo or keno game, a Class II game displayed using Class III visual elements (e.g., a video slot game that uses a bingo-based ball call), or any other suitable game.

In one embodiment, as illustrated in FIG. 1A, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming machine 10 awards prizes after the reels of the primary or base game stop spinning if specified types and/or configurations of indicia or symbols occur on an active payline or otherwise occur in a winning pattern, occur on the requisite number of adjacent reels and/or occur in a scatter pay arrangement.

Figure 3:
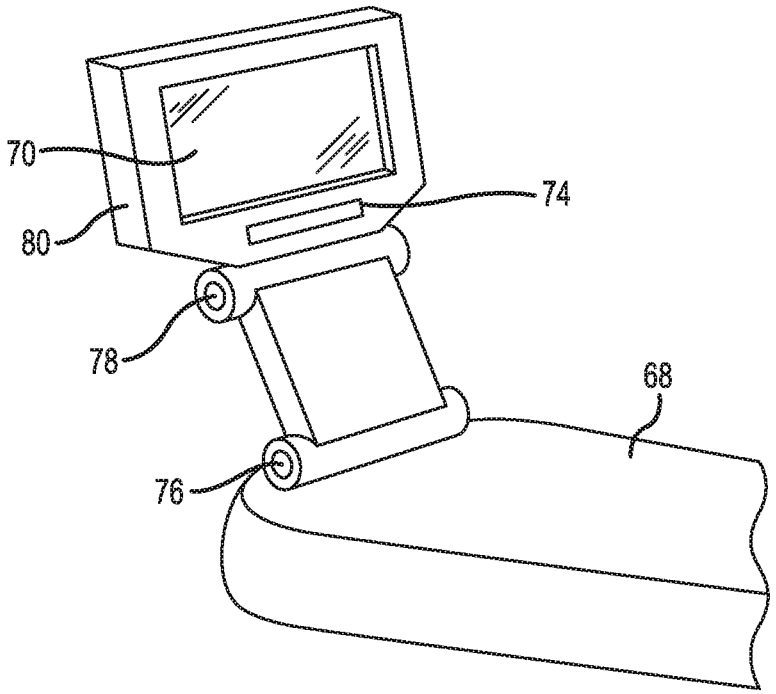
FIG. 3 illustrates a perspective view of a touchscreen integrated into a gaming chair, according to various embodiments.

With reference to FIG. 3, a perspective view of an example of touchscreen device 70 is shown, in accordance with various embodiments. Touchscreen device 70 is mechanically coupled to arm 68. Rotatable joint 76 may rotatably couple support 81 to arm 68. Support 81 may further be rotatably coupled to housing 80 by rotatable joint 78. Housing 80 may thus be selectively positioned relative to arm 68. Housing 80 may also retain touchscreen device 70 in position relative to arm 68 and/or a player in gaming chair 60. In that regard, a player sitting in gaming chair 60 (shown in FIG. 1A) may move touchscreen device 70 into a position suitable for interaction.

Although rotatable joints 76 and 78 along with housing 80 are illustrated as positioning touchscreen device 70, other positioning mechanisms are also envisioned and may use, for example, pivoting joints, telescoping supports, bendable supports, tracks, rollers, or other mechanical supports structures suitable for positioning a touchscreen device 70 relative to a gaming chair. Additionally, such positioning mechanisms may be coupled to any of the various portions of gaming chair 60 such as, for example, back 62, seat 64, a headrest, a base, or any other component of a gaming chair 10. Gaming chair 60 may also be positioned relative to gaming machine 10 at various distances, alignments, and angles of orientation and still facilitate the player's engagement with gaming machine 10 via touchscreen device 70, notwithstanding the controls built on to gaming machine 10 being out of the player's physical reach.

In various embodiments, the positioning mechanisms supporting touchscreen device 70 and facilitating selective positioning thereof may be electronically actuated components. The various components of gaming chair 60 may also be adjustable by electronic actuation. Users may position the back 62, seat 64, arm 68, and/or touchscreen device 70 chair using electronic switches to select the desired position in a manner similar to that of electronically adjustable automobile seats. Controls for adjustment of gaming chair 60 may be accessed through touchscreen device 70 or hardware switches mounted on gaming chair 60. The selected configuration for the chair may be retained in the player's profile and stored on an identification card, for example. The player may trigger repositioning of a gaming chair 60 into his desired configuration by associating his player profile with gaming chair 60. The player may establish such an association by inserting his identification card into gaming machine 10 and/or gaming chair 60, for example. Although an identification card is used for exemplary purposes, a key fob, mobile device, or other identification mechanism may also be used to retain the player's seating preferences and facilitating configuration into the player's preferred arrangement.

In various embodiments, the player may also adjust the settings of touchscreen device 70 via a settings interface. The player can adjust font size, image size, color settings, scroll rate, touch sensitivity, brightness, haptic settings, or other settings of touchscreen device 70 and/or gaming chair 60. In addition, the player may select a preferred interface from a collection of various possible interfaces. The selected settings may be stored using an identification mechanism, as described above. A touchscreen device 70 may be reconfigured to the player's preferred settings by associating his player profile with touchscreen device 70. In that regard, the player may re-establish his personalized configuration after leaving one gaming machine 10 and returning or engaging a similarly configured gaming machine 10. Touchscreen device 70 may be configurable to display a map of similarly equipped gaming machines within a predetermined area such as, for example, on a casino floor. Such a map may be displayable on user request or in response to the user signing out of gaming machine 10 and/or gaming chair 60.

In various embodiments, touchscreen device 70 may also comprise its own base and support structure to facilitate repositioning of touchscreen device 70 relative to gamine chair 10. Such a touchscreen device having a separate support structure may locate near and connected to a gaming machine 10 without gaming chair 10 present to accommodate players in wheelchairs, in casts, on crutches, or that might otherwise have difficulty sitting in gaming chair 10. Similar to the touchscreen device 70 coupled to gaming chair 60, suitable support structures for a detached touchscreen device may include pivoting joints, telescoping supports, bendable supports, tracks, rollers, lifts, ramps, poles, or other mechanical supports structures suitable for facilitating interaction with a player unsuited to using gaming chair 60.

Figure 4:
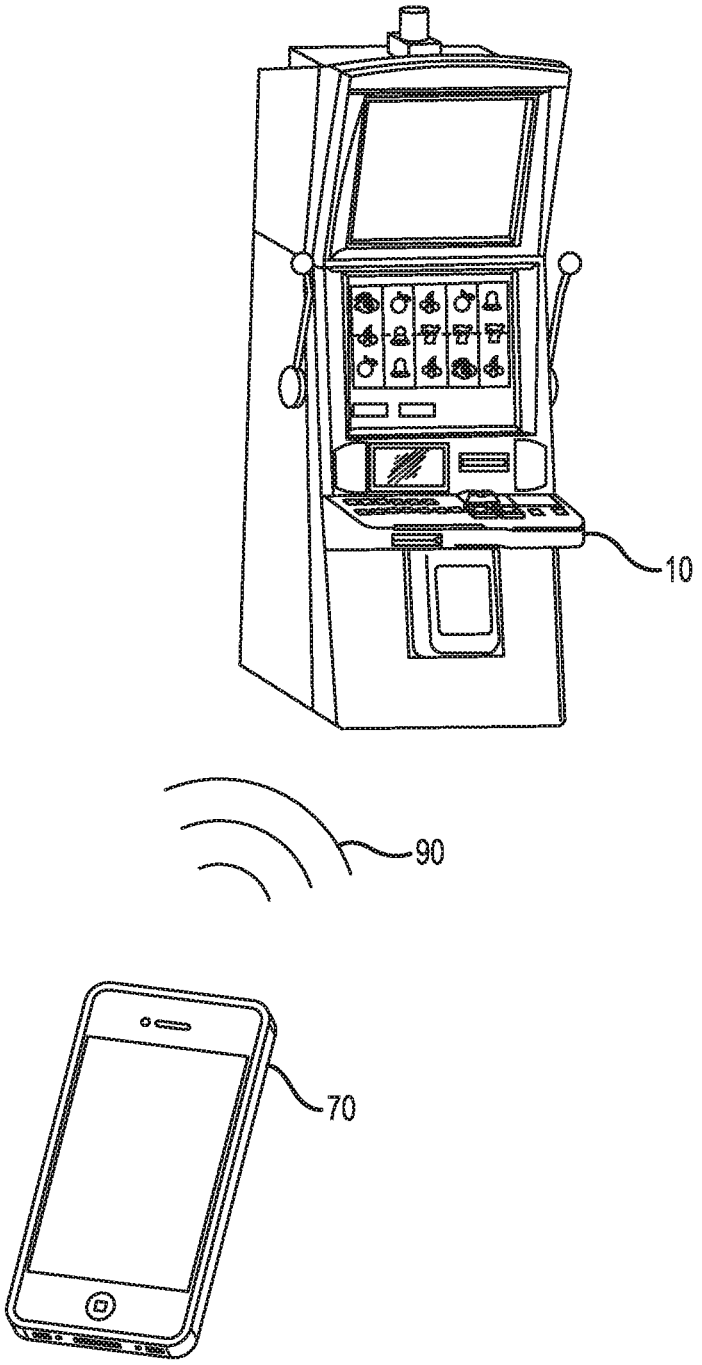
FIG. 4 illustrates a portable computing device configured to interact with a gaming machine, according to various embodiments.

Referring now to FIG. 4, a touchscreen device 70 separate from gaming chair 60 (of FIG. 1A) is shown, in accordance with various embodiments. Touchscreen device 70 may comprise, for example, a smart phone, a tablet, a smart wearable, an augmented reality device, or another suitable portable computing device. Touchscreen device 70 may run a client application such as a thin client (web) based, hybrid (i.e., web and native, such as iOS and Android), or a native application to interact with gaming machine 10. The application may authenticate the user, make payments, receive cash-out vouchers, and otherwise communicate with gaming machine 10 as described herein.

In various embodiments, touchscreen device 70 may communicate with gaming device 10 over a wireless communication channel 90. Wireless communication channel 90 may include, for example, a Bluetooth® channel or a Wireless Local Area Network (WLAN) as specified in the IEEE 802.11 standards. The wireless communications may be encrypted to protect against eavesdroppers, middle man attacks, or other security vulnerabilities. The application may thus use encryption to secure wireless communications. Encryption may be performed by way of any of the techniques now available in the art or which may become available such as, for example, Twofish, RSA, El Gamal, Schorr signature, DSA, PGP, PKI, GPG (GnuPG), or other symmetric and asymmetric cryptosystems.

Figure 5:
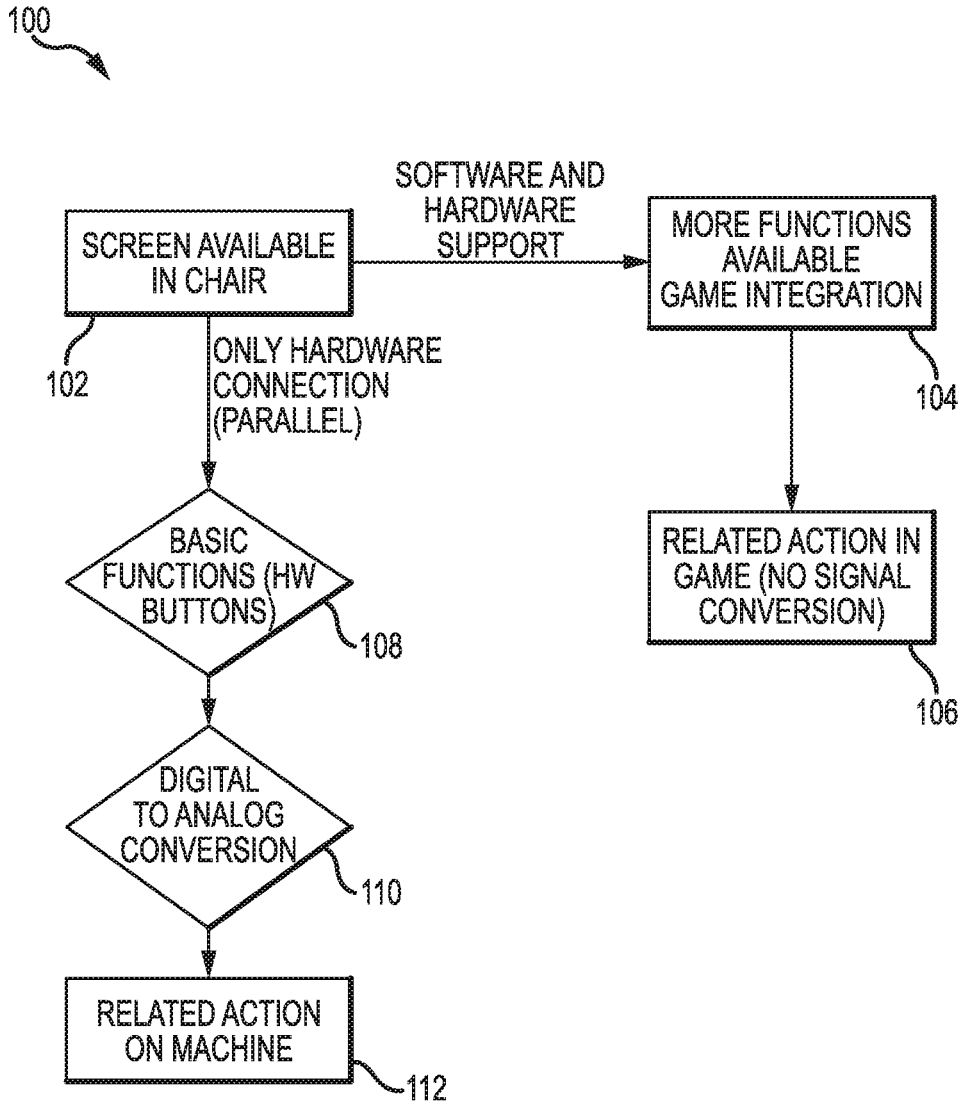
FIG. 5 illustrates a flow diagram of an exemplary process for integrating a touchscreen control with a gaming machine, according to various embodiments.

With reference to FIG. 5, an exemplary flow chart 100 illustrates the process of integrating into gaming machine 10 a touchscreen device 70 built into gaming chair 60, in accordance with various embodiments. The process may begin by installing a gaming chair 60 having a touchscreen device 70 integrated into the chair. Gaming machine 10 may detect that touchscreen device 10 is available (Block 102). Installation may include running an electrical conduit 72 from touchscreen device 70 to gaming machine 10. Electrical conduit 72 may be removably plugged into a port on gaming machine 10 that supports various input and output devices. The conduit may facilitate electronic communication between touchscreen device 70 and a controller or processor (e.g., processor 12) of gaming machine 10.

In various embodiments, gaming machine 10 may detect touchscreen device 70 by monitoring a hardware port for a connection. Gaming machine 10 may support basic functions that are available to existing hardware input and output devices via the hardware connection port (Block 108). Basic functions may include, for example, select game, cash out, retrieve information, select pay lines, play max bet, increase bet, decrease bet, stop a game, and/or request an attendant. Gaming machine 10 may perform the above actions in response to a signal from touchscreen device 70. The hardware connection may use the same or similar signals in use for communication between gaming machine 10 and preexisting input and output devices. When using a hardware only configuration, touchscreen device 70 may thus emulate and/or replicate preexisting input and output devices in communicating with gaming machine 10. It should be noted that although the term hardware only is used to describe a relatively rudimentary connection between gaming machine 10 and touchscreen device 70 using existing interfaces, the term hardware only is meant as non-limiting. A hardware only configuration may thus include software running on touchscreen device 70 and/or gaming machine 10 that supports basic functions associated with hardware input and output devices. Touchscreen device 70 may integrate with Limited Payout Machines (LPM), Amusement with Price Machines (APM), or other types of gaming machines in parallel with existing hardware.

Touchscreen device 70 may generate a digital signal. Gaming machine 10 may be configured to accept analog signals at its controller. Accordingly, a digital-to-analog conversion, via a digital-an-analog converter, may be performed on the signal generated by touchscreen device 70 (Block 110). The converted signal may trigger the action related to the signal on gaming machine 10 (Block 112).

In various embodiments, gaming machine 10 may support touchscreen device using a hardware connection in conjunction with software support. In addition to the above described hardware only support, touchscreen device 70 may further support functionality enabled with a firmware update, a controller update, or another suitable update to an existing gaming machine 10. The hardware and software support described above is meant in a non-limiting manner similar to the use of the term hardware only above. By updating gaming machine 10, more functions are available for game integration with touchscreen device 70 (Block 104). For example, in addition to the above enumerated hardware functions, a software solution may expand functionality to include picking a game, pay bonus selection, or other screens developed for touchscreen device 70. The digital signal generated by touchscreen device 70 may be processed and the gaming machine 10 may perform the selected action. Software for integrating touchscreen device 70 may be written to trigger an action in response to the digital signal generated by touchscreen device 70 without a digital-to-analog conversion (Block 106).

With reference to FIG. 5, an exemplary process 120 is shown for operating gaming machine 10 via a touchscreen device 70 integrated into gaming chair 60, in accordance with various embodiments. Touchscreen device 70 may act as a controller for gaming machine 10 by monitoring its screen and requesting state changes in response to detecting touches and/or gestures. Process 120 may begin when touchscreen device 70 detects a touch (Block 122). Touchscreen device 70 may determine whether the detected touch and/or gesture was in an eligible location (Block 124). The touch may be eligible if it corresponds to a valid request for a state change in at least one of touchscreen device 70 or gaming machine 10. A touch and/or gesture may be ineligible in response to being detected on a non-interactive portion of the interface displayed on touchscreen device 70. Touchscreen device 70 may disregard a touch or gesture in response to the touch or gesture being in an ineligible location (Block 126). Touchscreen device 70 may subsequently continue monitoring for future touches.

In various embodiments, touchscreen device 70 may determine a parameter to change in response to the touch being in an eligible location (Block 128). The touchscreen device may determine the parameter to change by matching the location of the screen where the touch was detected with the portion of the interface corresponding to the location. The parameter may be a parameter of the interface displayed on touchscreen device 70 and/or a parameter of gaming machine 10. For example, with brief reference to FIG. 1C, the touch detected may be a swipe gesture moving across interface 69 from right to left. Touchscreen device 70 may detect the swipe at a position on the screen displaying selection bar 73. Touchscreen device 70 may thus determine that a parameter change responsive to the touch would be moving the selection bar 73 display a distance commensurate with the distance of the swipe gesture.

Figure 6:
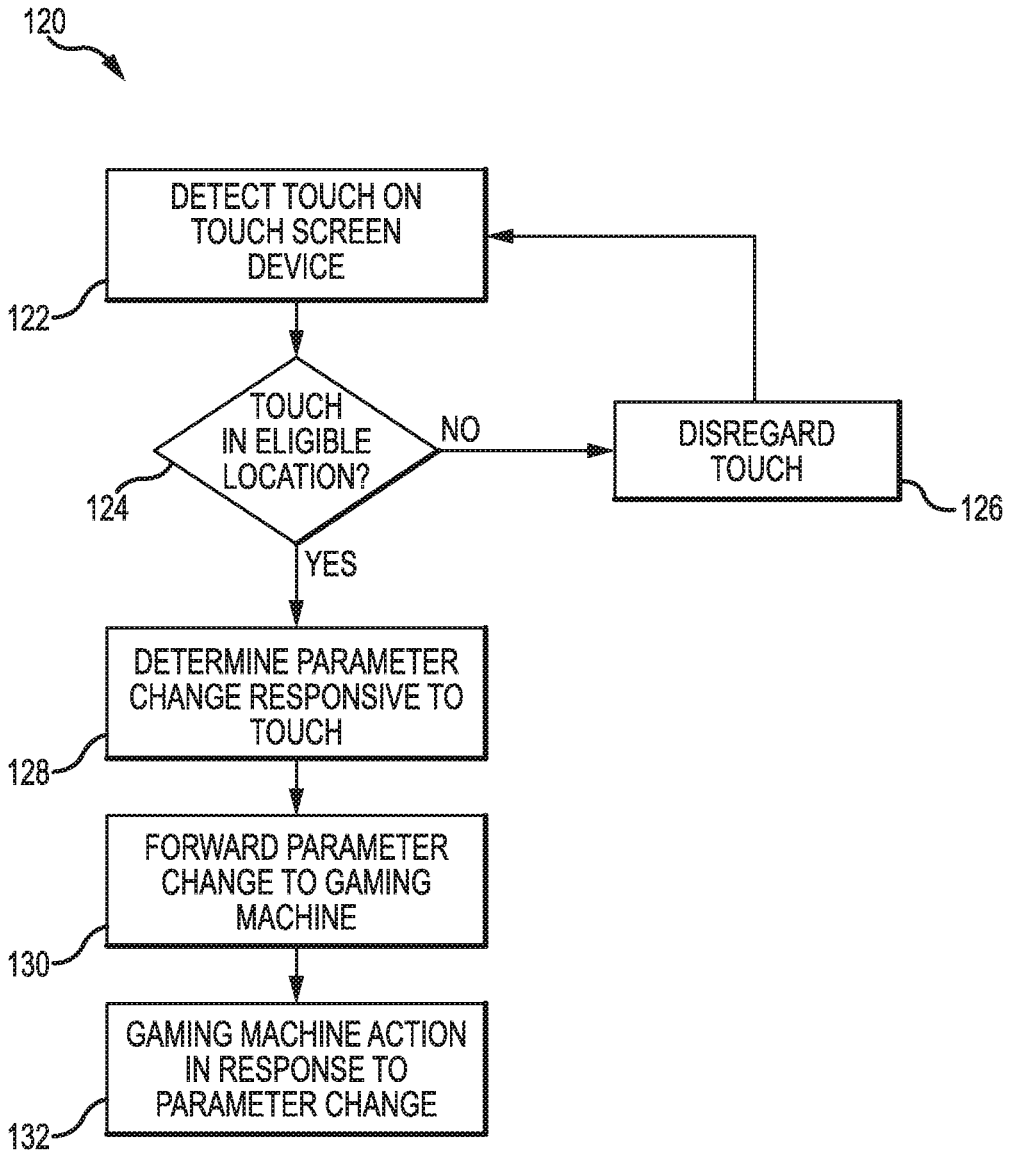
FIG. 6 illustrates an exemplary process for operating a gaming machine with a separate touchscreen device using an interactive interface, according to various embodiments.

In various embodiments and with continuing reference to FIG. 6, touchscreen device 70 may forward a parameter change to gaming machine 10 (Block 130). The parameter forwarded to gaming machine 10 may be associated with a state of gaming machine 10. The parameter may be selected from a list of parameters adjustable by touchscreen device 70. The parameter may comprise one or more of a wager amount, a start game request, a cash-out request, an information request, an attendant request, a pay line request, a bet request, a request for an attendant, or any other request to alter a state of gaming machine 10. Gaming machine 10 may then execute the action associated with the request (Block 132).

For example, a touch may be detected on selectable button 79 of interface 69 in FIG. 1C when the selectable button is displaying a start button, indicating that the selectable button corresponds to a request to start the game. Touchscreen device 70 may forward the request to start the game to gaming machine 10. Gaming machine 10 may then start a game in response to receiving the request to start the game from touchscreen device 70.

Gaming chairs and touchscreen devices disclosed herein tend to improve player comfort while seated at a gaming machine. The controls being placed closer to the player offer greater flexibility in performing various actions than having controls disposed only on the gaming machine itself. Users may enjoy playing for greater durations as a result of the greater comfort. The additional interface location provided by the touchscreen device also enables alternative and/or supplementary locations to integrate new game features. New features tend to improve player interest in gaming machines.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. In addition, various hardware components may be added to a gaming machine (such as gaming machine 10 depicted in FIG. 1A) allowing implementation of the embodiments discussed herein (e.g., buttons, levers, display screens, touchscreens, and the like) to allow presentation, display, and selection of different games on a gaming machine. It should also be understood that any method steps discussed herein, such as for example, steps involving the receiving or displaying data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system, comprising:

a gaming machine comprising:

a monetary input device configured to receive a physical item associated with a monetary value;

a wager input device configured to receive an input representative of a selected wager for a wagering game, the selected wager being selected from a list of approved wagers; and a processor coupled to the wager input device and a memory device;

a gaming chair to which a touchscreen device is coupled, wherein the touchscreen device is in electronic communication with the gaming machine, wherein the gaming machine is configured to perform an action in response to a signal from the touchscreen device, wherein the touchscreen device comprises a housing rotatably coupled to a support via a first rotatable joint, wherein the support is rotatably coupled to the gaming chair via a second rotatable joint, wherein the touchscreen device is adjustable relative to the support, and the support is adjustable relative to the gaming chair, and wherein the touchscreen device is configured to display an interactive interface comprising:

a selection frame fixed relative to a boundary of the interactive interface;

a selection bar comprising a plurality of buttons rendered behind the selection frame, wherein a button from the plurality of buttons is positioned within the selection frame; and a selectable button associated with the action, wherein the selectable button is rendered in response to the button positioned within the selection frame; and a digital-to-analog converter, wherein the touchscreen device transmits the signal requesting the action to the gaming machine, wherein the signal is a digital signal, and wherein the digital-to-analog converter is configured to convert the digital signal from the touchscreen device to an analog signal to be received by the gaming machine.

2. The system of claim 1, wherein the touchscreen device is coupled to an arm of the gaming chair.

3. The system of claim 2, wherein a position of the touchscreen device is adjustable relative to the arm of the gaming chair.

4. The system of claim 1, wherein the action comprises at least one of starting a game, cashing out, retrieving information, selecting pay lines, adjusting a bet, or requesting an attendant.

5. The system of claim 1, wherein the touchscreen device is removably coupled to the gaming machine by a conduit plugged into a hardware port of the gaming machine.

6. A method of operating a gaming system, comprising:

coupling a touchscreen device to a gaming chair of the gaming system, wherein the touchscreen device comprises a housing rotatably coupled to a support via a first rotatable joint, wherein the support is rotatably coupled to the gaming chair via a second rotatable joint, wherein the touchscreen device is adjustable relative to the support, and the support is adjustable relative to the gaming chair;

detecting a touch at a location on an interactive interface of the touchscreen device;

generating a request for an action in response to the location on the interactive interface corresponding to a selectable button associated with the action, wherein the request comprises a digital signal;

transmitting the request for the action to a gaming machine in electronic communication with the touchscreen device;

converting the digital signal via a digital-to-analog converter to an analog signal to be received by the gaming machine; and executing the action on the gaming machine in response to receiving the analog signal, wherein the touchscreen device is configured to display the interactive interface comprising:

a selection frame fixed relative to a boundary of the interactive interface;

a selection bar comprising a plurality of buttons rendered behind the selection frame, wherein a button from the plurality of buttons is positioned within the selection frame; and the selectable button associated with the action, wherein the selectable button is rendered in response to the button positioned within the selection frame.

7. The method of claim 6, wherein the action comprises at least one of starting a game, cashing out, retrieving information, selecting pay lines, adjusting a bet, or requesting an attendant.

8. The method of claim 6, wherein the touchscreen device is coupled to an arm of the gaming chair.

9. The method of claim 6, wherein the touchscreen device is in electronic communication with the gaming machine over a wireless communication channel.

10. The method of claim 9, further comprising running a native application on the touchscreen device to receive inputs in response the detected touch.

11. The method of claim 6, wherein the touchscreen device is in communication with the gaming machine over a conduit plugged into a hardware port of the gaming machine.

12. A gaming system, comprising:

a gaming machine;

a touchscreen device in electronic communication with the gaming machine, wherein the gaming machine is configured to perform an action in response to a signal from the touchscreen device;

a gaming chair to which the touchscreen device is coupled, wherein the touchscreen device is configured to display an interactive interface comprising:

a selection frame fixed relative to a boundary of the interface;

a selection bar comprising a plurality of buttons rendered behind the selection frame, wherein a button from the plurality of buttons is positioned within the selection frame; and a selectable button associated with the action, wherein the selectable button is rendered in response to the button positioned within the selection frame; and a digital-to-analog converter configured to convert a digital signal generated by the touchscreen device to an analog signal to be received by the gaming machine.

13. The gaming system of claim 12, wherein a position of the touchscreen device is adjustable relative to the gaming chair.

14. The gaming system of claim 12, wherein the touchscreen device is in communication with the gaming machine via a conduit plugged into a hardware port of the gaming machine.

15. The gaming system of claim 12, wherein the action comprises at least one of starting a game, cashing out, retrieving information, selecting pay lines, adjusting a bet, or requesting an attendant.

16. The gaming system of claim 12, wherein the touchscreen device is pivotally coupled to an arm of the gaming chair.

17. The gaming system of claim 12, wherein the touchscreen device comprises a housing rotatably coupled to a support via a first rotatable joint, wherein the support is rotatably coupled to the gaming chair via a second rotatable joint, wherein the touchscreen device is adjustable relative to the support, and the support is adjustable relative to the gaming chair.

* * * * *